United States Patent [19]

Ehring

[11] Patent Number: 4,543,670

[45] Date of Patent: Oct. 1, 1985

[54] SLEEVE ATTACHMENT FOR MULTILAYERED PROTECTIVE COAT

[75] Inventor: Carolyn C. Ehring, West Caldwell, N.J.

[73] Assignee: Cairns & Brother Inc., Clifton, N.J.

[21] Appl. No.: 651,801

[22] Filed: Sep. 18, 1984

[51] Int. Cl.[4] ..... A41D 3/02

[52] U.S. Cl. ..... 2/85; 2/124; 2/269; 2/270

[58] Field of Search ..... 2/16, 85, 87, 123, 124, 2/125, 126, 269, 270

[56] References Cited

U.S. PATENT DOCUMENTS

| | | | |
|---|---|---|---|
| 954,311 | 4/1910 | Leiner | 2/270 |
| 1,784,285 | 12/1930 | Heaton | 2/270 |
| 2,670,471 | 3/1954 | Kaufman | 2/269 X |
| 3,533,108 | 10/1970 | Feldser | 2/269 X |
| 3,811,132 | 5/1974 | Segonzac et al. | 2/270 |
| 3,889,297 | 6/1975 | Jarboe et al. | 2/123 X |
| 4,068,316 | 1/1978 | Haywood | 2/269 X |
| 4,507,806 | 4/1985 | Coombs | 2/85 |

*Primary Examiner*—Louis K. Rimrodt
*Attorney, Agent, or Firm*—Louis E. Marn

[57] ABSTRACT

There is disclosed a novel sleeve attachment of a multilayered protective coat comprised of an outer shell and an inner thermal liner, the sleeve attachment including a detachable, innersleeve wristlet assembly comprised of a wristlet and a flexible innersleeve circumferentially secured to the wristlet. The flexible innersleeve is configured to form a plurality of telescoping annular layers, and has secured thereto a fastening means for cooperation with a fastening means circumferentially secured to the sleeve of the outer shell for establishing a removable, circumferential attachment between the flexible innersleeve and the sleeve of the outer shell. The novel attachment provides continuous thermal protection within the coaxial combination of outer shell sleeve, the inner thermal liner sleeve, the flexible innersleeve and the wristlet, notwithstanding relative axial movement between the wristlet and such sleeves. Also, the flexible innersleeve acts as a barrier to any debris or water from entering the coat by way of spaces between the wristlet and the sleeve of the outer shell.

9 Claims, 2 Drawing Figures

SLEEVE ATTACHMENT FOR MULTILAYERED PROTECTIVE COAT

FIELD OF INVENTION

This invention relates to an improved sleeve attachment of a multilayered protective coat, and more particularly to a sleeve attachment that includes a detachable, innersleeve wristlet assembly capable of telescoping axial movement.

BACKGROUND OF THE INVENTION

In an effort to provide improved protection for firefighters, multilayered protective coats of the type, for example, described in, of common assignee, in copending U.S. patent application Ser. No. 470,462, filed Feb. 28, 1983, now U.S. Pat. No. 4,507,806, issued Apr. 2, 1985, have been developed to provide more effective protective envelopes about the wearer thereof. Generally, a coat of such type includes: (i) a damage-resistant outer shell having an openable body portion with sleeves appended thereto, and a closure means such as a zipper or other fastening means for securing the openable body portion; (ii) an inner thermal liner comprised of a body portion having appended thereto sleeves and closure means which is substantially coincidental with the closure means of the outer shell; and (iii) a means for removable securing the outer shell to the inner liner. The inner liner of such a coat includes an interior thermal layer which is comprised of material suitable to provide thermal insulation, and a barrier layer comprised of a material suitable to provide a moisture barrier, the barrier layer being fixedly secured to the exterior surface of the thermal layer.

As multilayered protective coats for firefighters have been improved through the employment of more effective insulative materials, moisture barriers and protective outer shells to provide more effective protective envelopes, there has been the problem of entrapment within such protective envelopes of the moisture generated by the firefighter's own body. To obviate the difficulties presented to a firefighter as the result of the saturation of his inner garments due to such moisture entrapment, the multilayered protective coats of the aforesaid type are especially configured for prompt and simple assembly and disassembly, in the field or at the firehouse, so as to permit the removal of the perspiration soaked inner liner for replacement purposes, and/or for cleaning and drying of same.

The present invention, though directed to improving the integrity of the protective envelopes provided by such multilayered protective coats, is cognizant of the importance of such coats being of a design appropriate for prompt and simple assembly and disassembly. More particularly, the sleeve attachment of the present invention for multilayered protective coats, includes an inner sleeve wristlet assembly that may be attached or detached from the multilayers of a sleeve of the multilayered protective coat in a highly expeditious manner, thus presenting no impediment to the aforesaid required prompt and simple assembly and disassembly of the multilayered protective coat taken as a whole.

The demands placed upon a firefighter in dealing with a structural fire are numerous and often in conflict. Generally, each part of the firefighters anatomy should remain within the protective envelope provided by his protective garments and associated accessories so as to avoid injury from the excessive temperatures, flying debris and other hazards of a structural fires. At the same time, the firefighter must have full body mobility, including the ability to fully extend his arms in an upright direction. Existing multilayered protective coats are often encumbered as follows: when a firefighter's arm is extended in an upright position, the wristlet attached to the coat sleeve rides up on the firefighter's arm, exposing his wrist to the fire environment. Additionally, when the arm is in a raised position water and debris (including burning embers) may enter the coat between the sleeve of the outer shell and the sleeve of the inner liner.

OBJECTS OF THE INVENTION

An object of the present invention is to provide a novel sleeve attachment of a multilayered protective coat, which includes a detachable, innersleeve wristlet assembly capable of telescoping axial movement.

Another object of the present invention is to provide a novel sleeve attachment of a multilayered protective coat, which provides wrist protection beyond the cuff area of the sleeve to which it is attached.

Still another object of the present invention is to provide a novel sleeve attachment of a multilayered protective coat that permits the sleeve to which it is attached to move freely along the arm as the firefighter's movements require without the axial movement of the wristlet of such attachment off the wrist.

A further object of the present invention is to provide a novel sleeve attachment of a multilayered coat that keeps water and debris from entering the coat between the multilayers of the sleeve in a raised position.

Yet a further object of the present invention is to provide a novel sleeve attachment of a multilayered coat, which includes a detachable, innersleeve wristlet assembly which may be readily attached to, or detached from, the multilayered sleeve.

SUMMARY OF THE INVENTION

These and other objects of the present invention are achieved by a sleeve attachment of a multilayered protective coat, comprised of a detachable, innersleeve wristlet assembly including a tubular wristlet and a flexible innersleeve circumferentially secured to the tubular wristlet. The flexible innersleeve is folded in an axial direction to form a plurality of telescoping annular layers, and has circumferentially secured thereto a fastening means for cooperation with a fastening means circumferentially secured to the outer shell sleeve for establishing a removable, circumferential attachment between the flexible innersleeve and the outer shell sleeve, as more fully herein disclosed.

BRIEF DESCRIPTION OF THE DRAWINGS

A better understanding of the present invention as well as other objects and advantages thereof will become apparent upon consideration of the following detailed disclosure thereof, especially when taken with the accompanying drawings, wherein:

Referring to FIGS. 1 and 2, there is illustrated an outer shell sleeve 21 of damage-resistant material suitable for providing fire protection, and positioned therewithin, a thermal layer sleeve 20 of a firefighter's protective coat of the type disclosed in the aforesaid U.S. patent application Ser. No. 470,462, filed Feb. 28, 1983, now U.S. Pat. No. 4,507,806. Further, illustrated is an innersleeve wristlet assembly 10 that includes a wristlet 11 and an innersleeve 12 that are formed with a unitary configuration. The wristlet 11 is comprised of a thermal insulative material for fire protection, that is formed in a manner to provide a snug elastic fit on the wearer's wrist. The innersleeve 12 is comprised of a flexible, insulative material for fire protection (for example, a thermal insulative material such as Kevlar® coated with neoprene). A peripheral portion 13 of the innersleeve 12 is positioned within and circumferentially secured to a peripheral upper portion 14 of the wristlet 11 to form a circumferential attachment 9. The innersleeve 12 has a cross-section that increases in circumference in the axial direction away from the peripheral portion 13, thus permitting the innersleeve 12 to be folded in the axial direction about itself, to form four annular layers 16, 17, 18 and 19. The annular layer 16 has circumferentially secured thereto on an outer surface 8 a VELCRO® fastening means 22, and on an inner surface 23, a VELCRO® fastening means 24. Though the embodiment disclosed herein will reference the use of VELCRO® fastening means, other suitable fastening means may be used without departing from the scope of the invention. Connected to the innersleeve 12, at separated circumferential positions within the annular layer 19, are a pair of restraining tabs 25 and 25'. Each of the restraining tabs 25 and 25' has one end that is fixedly attached to the innersleeve 12, and an opposite end that includes a snap fastening means 26 and 26'. Included in the lower end of the thermal layer sleeve 20, at separated circumferential positions, are a pair of snap fastening means 27 and 27' to which are attachable, respectively, the snap fastening means 26 and 26'.

Figure 1:
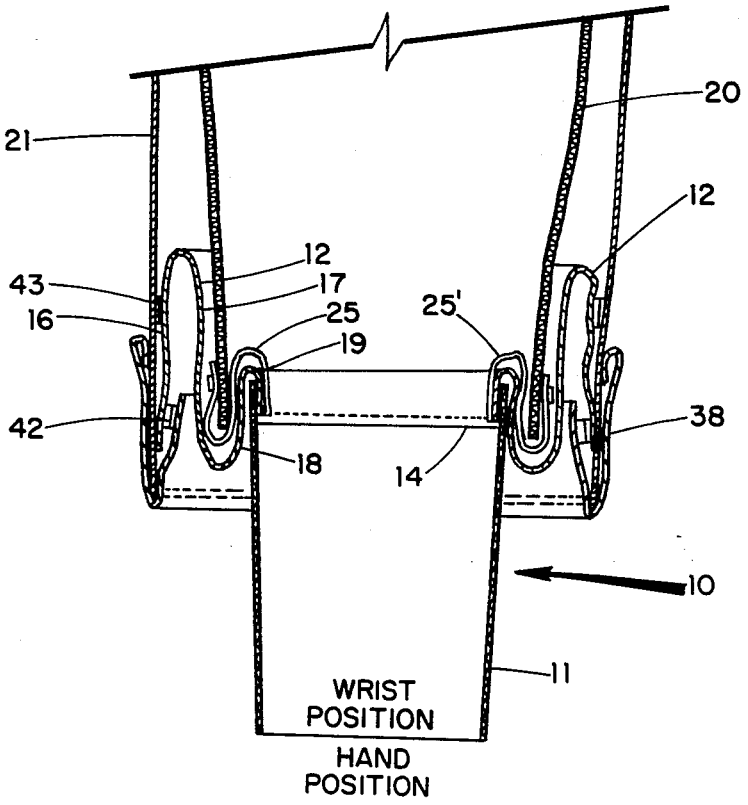
FIG. 1 is an elevational view of an embodiment of the invention in which an innersleeve wristlet assembly is circumferentially attached to an inner surface of an outer shell sleeve of a firefighter's multilayered protective coat.
Figure 2:
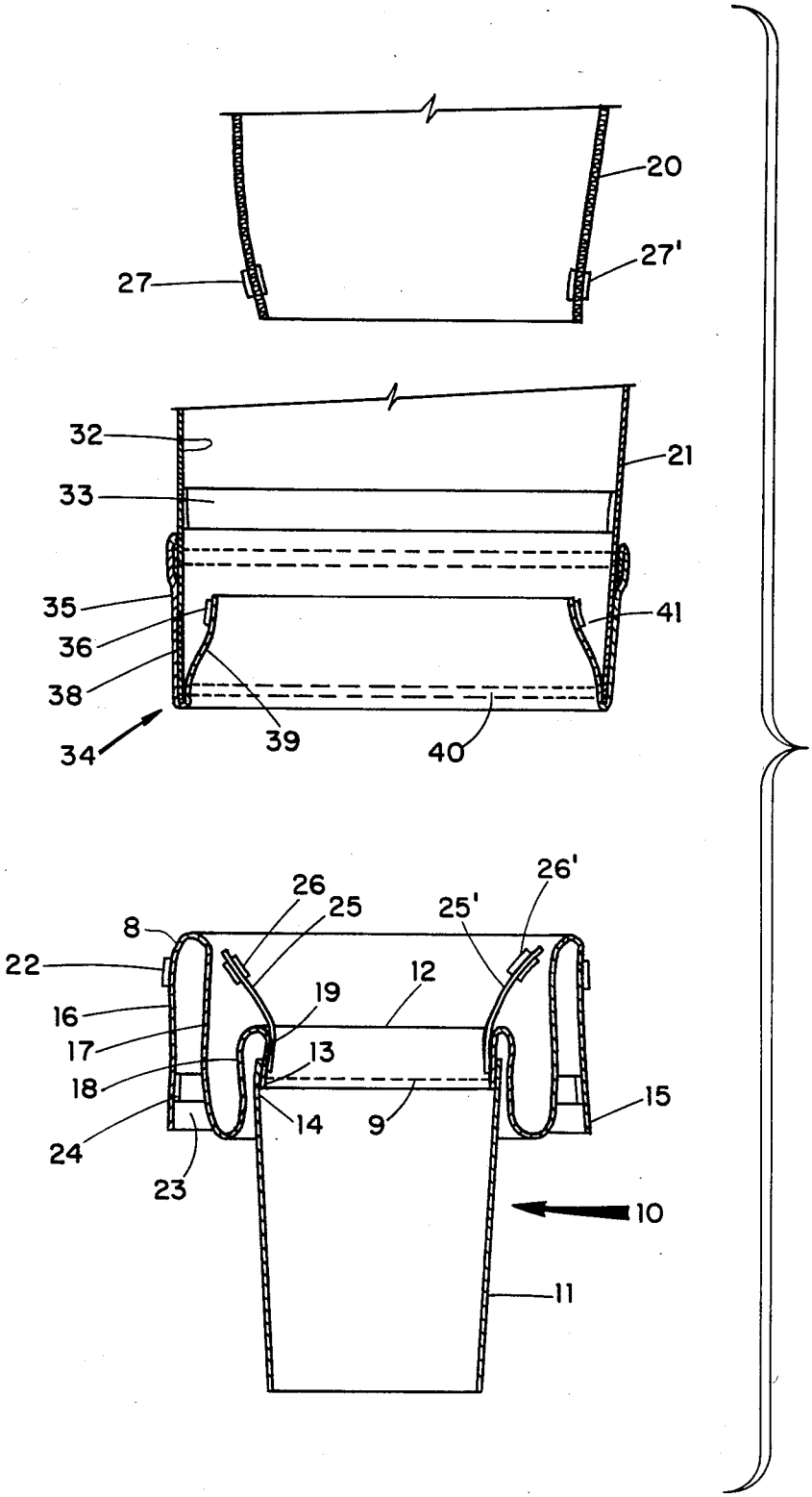
FIG. 2 is an exploded elevational view of the embodiment depicted in FIG. 1, in which the innersleeve wristlet assembly is in a detached condition.

The outer shell sleeve 21 has circumferentially secured thereto, on an inner surface 32, a VELCRO® fastening means 33 that is attachable to the VELCRO® fastening means 22 secured to the annular layer 16 of the innersleeve 12. Additionally, the outer shell sleeve 21 includes an annular cuff assembly 34 comprised of an annular cuff 35 that is folded around the peripheral end portion of the outer shell sleeve 21 to form an outer cuff layer 38, and an inner cuff layer 39. The outer cuff layer 38 is circumferentially secured to the outer surface of the outer shell sleeve 21 so as to lie flat thereagainst, while the inner cuff layer 39 is angularly secured to the outer shell sleeve 21 at a peripheral area 40. The inner cuff layer 39 has a cross-section of decreasing circumference in the axial direction away from the peripheral area 40, and forms an annular cuff groove 41 with the adjacent inner surface of the outer shell sleeve 21. On a surface of the inner cuff layer 39 facing the cuff groove 41, there is circumferentially secured thereto a VELCRO® fastening means 36 that is attachable to the VELCRO® fastening means 24 secured to the annular layer 16 of the innersleeve 12.

To achieve the condition of attachment of the innersleeve wristlet assembly 10 illustrated in FIG. 1, the snap fastening means 26 and 26' of the restraining tabs 25 and 25' are attached, respectively, to the snap fastening means 27 and 27' of the thermal layer sleeve 20. The innersleeve wristlet assembly 10 is then moved axially into the cuff area of the outer shell sleeve 21 until the annular layer 16 of the innersleeve 12 passes through the inner cuff layer 39 of the cuff 35. Upon the completion of such passage, the movement of the innersleeve wristlet assembly 10 is reversed and moved in the opposite axial direction until the open end portion of the annular layer 16 is positioned in the annular groove 41. When the annular layer 16 is so positioned, the VELCRO® fastening means 24 is in alignment with, and directly adjacent to, the VELCRO® fastening means 36; and the VELCRO® fastening means 22 is in alignment with, and directly adjacent to the VELCRO® fastening means 33. The aligned VELCRO® fastening means 24 and 36 engage each other to form a circumferential attachment 42 between the outer shell sleeve 21 and the innersleeve 12. Similarly, the aligned VELCRO® fastening means 22 and 33 engage each other to form a circumferential attachment 43 between the outer shell sleeve 21 and the innersleeve 12. As a result of the circumferential attachments 42 and 43, and the circumferential attachment 9 between the peripheral portion 13 of the innersleeve 12 and the wristlet 11, there is provided continuous thermal protection within the coaxial combination of the outer shell sleeve 21 and the thermal layer sleeve 11, the innersleeve 12 and the wristlet 11. Further, the circumferential attachments 43 and 42, and the circumferential attachment 9, permit the innersleeve 12 to act as a barrier to any debris (including burning embers) or water from entering the protective garment by way of the spaces between the wristlet 11 and the outer shell sleeve 21.

In the preferred embodiment of the invention, the innersleeve 12 is approximately long enough so as to permit extensive axial movement (telescoping action) of the annular layers 17, 18 and 19 of the innersleeve 12, without breaking or detaching the circumferential attachments 43 and 42. In particular, the wristlet 11 may be moved axially away from the thermal layer sleeve 20, with the annular layers 18 and 19 of the innersleeve 12 unfolding, to an axial point whereat the wristlet 11 is beyond the annular cuff 35 of the outer shell sleeve 21. The limitation upon the movement of the annular layers 17, 18 and 19 of the innersleeve 12, so as to avoid detachment of the circumferential attachments 43 and 42, is provided by the attached restraining tabs 25 and 25'. The length of the restraining tabs 25 and 25' is made approximately $2\frac{1}{2}$ inches long so as to permit the wristlet 11 to move axially up and down with respect to the thermal layer sleeve 20 a total distance of approximately 4 inches. As the restraining tabs 25 and 25' are connected between the thermal sleeve 20 and the annular layer 19 of the innersleeve 12, the unfolding of the annular layers 18 and 19 of the innersleeve 12 is terminated when the restraining tabs 25 and 25' are fully extended from the thermal layer sleeve 20.

To detach the innersleeve wristlet assembly 10 from the outer shell sleeve 21 and the thermal layer sleeve 20, the snap fastening means 26 and 26' of the restraining tabs 25 and 25', are detached, respectively, from the snap fastening means 27 and 27' of the thermal layer sleeve 20. The wristlet 11 is then pulled axially away from the cuff area of the outer shell sleeve 21, causing the annular layers 19, 18, 17 and 16 of the innersleeve 12 to unfold and the VELCRO® fastening means 22 and 32, and 24 and 36, to sequentially detach. The circumferential attachments 43 and 42 are thus eliminated, and the open end of the annular layer 16 slides out of the cuff groove 41, resulting in the innersleeve wristlet assembly 10 being completely detached from the outer shell sleeve 21 and the thermal layer sleeve 20.

Though the aforesaid description of the attachment and detachment of the innersleeve wristlet assembly 10 encompasses numerous interrelated components and sequential criteria, such attachment and detachment may be performed readily by the firefighter in the field, as well as in the station house. The simplicity and ease of such attachment with the assurance that the innersleeve wristlet 10 will not unintentionally detach during the actual use, as provided by the restraining tabs 25 and 25' when attached to the thermal layer sleeve 22, and the simplicity and ease of such detachment when the restraining tabs 25 and 25' are detached from the thermal layer sleeve 22, are significant advantages of the instant invention.

While the invention herein has been described in connection with an exemplary embodiment thereof, it will be understood that many modifications will be apparent to those of ordinary skill in the art and that this application is intended to cover any adaptations or variations thereof. Therefore, it is manifestly intended that this invention be only limited to the claims and the equivalents thereof.

What is claimed:

1. In a multilayered protective coat for firefighters, an improved sleeve attachment comprising:

an outer shell sleeve having a first fastening strip circumferentially secured to an inner surface thereof;

a cuff assembly including an annular cuff layer secured to said inner surface of said outer shell sleeve and forming an innersleeve alignment groove therebetween;

a thermal layer sleeve positioned within said outer shell sleeve; and a detachable, innersleeve wristlet assembly including:

a wristlet comprised of thermal insulative material;

an innersleeve comprised of thermal, insulative material, said innersleeve having a first open end thereof secured to said wristlet, said innersleeve being folded about itself to form a plurality of annular layers;

a second fastening strip circumferentially secured to an outer annular layer of said plurality of annular layers, said outer annular layer being partially positioned within said innersleeve alignment groove to align said second fastening strip with said first fastening strip to provide a first circumferential attachment between said innersleeve and said outer shell sleeve; and flexible tab fastening means connectible between said thermal layer sleeve and said innersleeve, in the proximity of said wristlet, for providing an expansion limit to the telescoping movements of said innersleeve so as to retain said first circumferential attachment.

2. An improved sleeve attachment in accordance with claim 1, wherein a third fastening strip is circumferentially secured to a surface of said annular cuff layer within said innersleeve alignment groove, and a fourth fastening strip is circumferentially secured to an inner surface of said outer layer of said plurality of annular layers, said fourth fastening strip and said third fastening strip cooperating to provide a second circumferential attachment between said innersleeve and said cuff layer secured to said outer shell sleeve.

3. In a multilayered protective overcoat for firefighters, an improved sleeve attachment comprising:

an outer shell sleeve having first fastening means circumferentially secured thereto;

an innersleeve alignment means secured to an inner surface of said outer shell sleeve;

a thermal layer sleeve positioned within said outer shell sleeve; and a detachable, innersleeve wristlet assembly including:

a tubular wristlet having a first peripheral open end position;

a flexible innersleeve having a first peripheral open end portion and a second peripheral open portion, said first peripheral end portion being circumferentially secured to said first open end portion of said tubular wristlet, said flexible innersleeve being folded in an axial direction so as to form a plurality of telescoping annular layers, said flexible innersleeve having second fastening means circumferentially secured thereto for cooperation with said first fastening means of said outer shell sleeve to form a circumferential attachment between said flexible innersleeve and said outer shell sleeve; and flexible tab means connectible between said thermal layer sleeve and said first peripheral open portion of said flexible innersleeve, said flexible tab means having an extended condition that limits the axial expansion of said plurality of annular layers of said flexible innersleeve, for avoiding opening stresses being applied to said circumferential attachment.

4. An improved sleeve arrangement in accordance with claim 3, wherein said peripheral open end portion of said flexible innersleeve is bonded to, and positioned within, said first peripheral open end portion of said tubular wristlet to provide a circumferential seal between said flexible innersleeve and said flexible wristlet.

5. An improved sleeve arrangement in accordance with claim 3, wherein said flexible tab means comprises a pair of restraining tabs, each of said restraining tabs having one end fixedly attached to said first peripheral open end portion of said flexible innersleeve, and each of said restraining tabs having included in the other end thereof a fastening means for securing said restraining tabs to said thermal layer sleeve.

6. An improved sleeve arrangement in accordance with claim 5, wherein said thermal layer sleeve has included in its cuff area a pair of fastening means each attachable to one of said fastening means of said restraining tabs.

7. An improved sleeve arrangement in accordance with claim 3, wherein said flexible innersleeve has a cross-section that increases in circumference in the direction away from said first peripheral open end portion to said second peripheral open end portion.

8. An improved sleeve arrangement in accordance with claim 3, wherein said plurality of telescoping annular layers includes an outer annular layer, said outer annular layer having included therein said second peripheral open end portion of said flexible sleeve and said second fastening means secured to said flexible innersleeve.

9. An improved sleeve arrangement in accordance with claim 8, wherein said second fastening means comprises a first and second fastening strip circumferentially secured, respectively, to an outer and inner surface of said outer annular layer of said plurality of telescoping annular layers of said flexible innersleeve, said innersleeve alignment means comprises an annular cuff layer secured to the innersurface of said outer shell sleeve for forming an annular groove with said inner surface, and said first fastening means comprises first and second fastening strips circumferentially secured, respectively, to said inner surface of said outer shell sleeve and a surface of said annular cuff layer of said outer shell sleeve.

* * * * *